US006351241B1

(12) United States Patent
Wass

(10) Patent No.: US 6,351,241 B1
(45) **Date of Patent: *Feb. 26, 2002**

(54) MEANDER ANTENNA DEVICE

(75) Inventor: Bo Wass, Linköping (SE)

(73) Assignee: Allgon AB, Åkersberga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/387,831

(22) Filed: Sep. 1, 1999

Related U.S. Application Data

(63) Continuation of application No. 08/872,921, filed on Jun. 11, 1997.

(30) Foreign Application Priority Data

Jun. 15, 1996 (SE) ..... 9602387

(51) Int. Cl.[7] ..... H01Q 1/24
(52) U.S. Cl. ..... 343/702; 343/895
(58) Field of Search ..... 343/702, 715, 343/895, 900, 901

(56) References Cited

U.S. PATENT DOCUMENTS

| | | | | |
|---|---|---|---|---|
| 4,313,119 A | | 1/1982 | Garay et al. | 343/702 |
| 4,860,020 A | | 8/1989 | Wong et al. | 343/828 |
| 4,987,424 A | | 1/1991 | Tamura et al. | 343/795 |
| 5,374,937 A | * | 12/1994 | Tsunekawa et al. | 343/895 |
| 5,526,003 A | | 6/1996 | Ogawa et al. | 343/700 |
| 5,559,524 A | * | 9/1996 | Takei et al. | 343/895 |
| 5,892,483 A | * | 4/1999 | Hayes et al. | 343/702 |
| 6,031,496 A | * | 2/2000 | Kuittinen et al. | 343/702 |
| 6,069,592 A | * | 5/2000 | Wass | 343/895 |

FOREIGN PATENT DOCUMENTS

| | | |
|---|---|---|
| GB | 2293275 | 3/1996 |
| JP | 8-46417 A | 2/1996 |
| SE | 509641 | 2/1999 |
| WO | WO85/02719 | 6/1985 |
| WO | WO96/38879 | 12/1996 |
| WO | WO96/38882 | 12/1996 |

OTHER PUBLICATIONS

Japanese Patent Abstract of JP5347507 published Dec. 27, 1993, "Antenna for portable radiotelephone", Junkosha Co LTD.

Japanese Patent Abstract of 63–29204 (A) published Sep. 12, 1988, "Antenna for Portable Radio Equipment", Hitachi Ltd.

* cited by examiner

*Primary Examiner*—Tan Ho
(74) *Attorney, Agent, or Firm*—Jacobson Holman, PLLC

(57) ABSTRACT

An antenna means for a portable radio communication device, in particular a hand-portable mobile telephone, having at least one radiating element that has a meandering and cylindrical configuration. This structure is specifically advantageous in combination with an extendable and retractable whip antenna and, when having two or more meandering radiating elements, in multi-band radiating structures. The antenna device is suitable for manufacturing in large quantities, for example by a flexible printed circuit board technique.

59 Claims, 7 Drawing Sheets

MEANDER ANTENNA DEVICE

This application is a con't of Ser. No. 08/872,921 filed Jun. 11, 1997.

BACKGROUND OF THE INVENTION

1. Field of the Invention

The present invention relates to an antenna means for a portable radio communication device, comprising a radiating first element tuned to a first frequency, the first element having a central longitudinal first axis, first and second ends being a first feed point and a first open end, respectively, and a meander configuration. Specifically, the invention concerns an antenna means for a hand-portable mobile telephone, which requires a compact and efficient antenna. The inventive antenna means is particularly advantageous when two or more radiating elements are to be combined or when an impedance matching means is required for matching radiating element(s) of the antenna means to transmitter/receiver circuitry of the telephone.

A general problem that occurs when the size of an antenna radiator is reduced is a reduction in its relative bandwidth. Helically configured radiators are commonly used when antennas are required to fit in confined volumes with limited height. However, the loops of a helical antenna generate a magnetic field that binds energy, which results in a further reduction of the bandwidth. Also, helical radiators have the problem of strong inter-coupling when two or more radiators are arranged close to each other.

2. Prior Art

GB-A 2 280 789 discloses an antenna means having multiple turns formed by a conductive radiating element formed on a dielectric substrate. The substrate may be tubular having conductive strips on one side, the strips being joined together along meeting edges of the tubular substrate. In another embodiment, the substrate is flat and has conductor strips deposited on both sides, the strips being joined together by feed-throughs along opposite edges of the substrate. That prior art antenna device has the inherent drawbacks of helical antennas, and is difficult and complicated to manufacture because of the need to provide feed-throughs in the substrate or joining conductors at edges.

Although relatively efficient and compact, there is a great variety of prior art antenna devices that involve the above-mentioned problems due to the use of helical radiators. Such antenna devices are disclosed in, for example, European Patent Applications published under Nos. 0 635 898 A1, 0 593 185 A1, and 0 467 822 A2, PCT Applications published under Nos. WO 94/10720 and WO 95/08199, and U.S. Pat. No. 4,868,576.

In the past, meander antennas have been used when an antenna device is required to have a total length which is short in relation to the wavelength at which an associated transmitter/receiver is operated. DE-A1 31 29 045 discloses a direction finder antenna having, for example, a meander structure. A radiating element thereof has a meandering configuration and is mounted on a dielectric carrier.

DE-A1 31 29 045 is considered to disclose the prior art antenna closest to the invention. The problem to be solved thereby is reducing the height of a direction finder antenna, in particular to render it concealable and mobile However, it only discloses a meander antenna which has a flat configuration. Moreover, the teachings thereof include improving the bandwidth of the antenna by using a conductor having relatively high resistance, leading to a less efficient antenna.

Further, there are no provisions for obtaining a mechanically durable antenna, an antenna suited to fit in a limited volume or an antenna to be combined with other types of antennas.

Another plane meandering antenna element is disclosed in Abstracts of Japan 60 E 1572 (publication No. 6-90108), and includes a meandering dipole and a matching means connected to a coaxial transmission line. A meandering feed arrangement for a helical antenna is disclosed in U.S. Pat. No. 5,298,910. In none of the latter two devices, a transmission line is connected to an end of the meandering conductor.

The pending Swedish Patent Application No. 9601706-6 includes means integrated with the antenna for matching the antenna to circuitry of a hand-portable mobile telephone. A similar matching means is suitable also in the present invention. The above-mentioned Swedish Patent Application is therefore incorporated herein by this reference.

SUMMARY OF THE INVENTION

An object of the invention is to provide an efficient antenna means for a portable radio communication device, comprising a radiating first element tuned to a first frequency, the first element having a central longitudinal first axis, first and second ends being a first feed point and a first open end, respectively, and a meander configuration, which solves the problem of providing an antenna means that is mechanically durable and has a geometry suited for location in a small volume. Further objects are to provide substitutes for helical radiators which also give improved antenna performance, to overcome the above-mentioned problem of binding electromagnetic energy in the radiator or radiators of the antenna means, to avoid feed-throughs in a carrier carrying the radiating element(s), to provide an efficient and cost-effective impedance matching means integrated with the antenna means, to provide a configuration which is both efficient and mechanically durable, to enable the use of more precise production techniques that, e.g., wound helices, and to provide an antenna wherein different radiating elements may be combined without being adversely inter-coupled, especially wherein the combination includes an extendable whip antenna.

These and other objects are attained by an antenna means in which the first element alternately extends in positive and negative angular directions in relation to the first axis. This radiator geometry has been found to be particularly advantageous with regard to stability, bandwidth and radiating properties. The radiating first element of this antenna means is a meandering conductor which is arched or bent so that it will occupy a space similar to that occupied by a helical radiating element. This configuration enables the antenna means of the invention to be used in most application in radio communication devices, especially for mobile telephones, where helical antennas have been used in the past. In comparison with a helical antenna, the advantages of using the antenna device of the invention are, for example, a greater bandwidth, improved production tolerances leading to less rejections, a lower degree of coupling to any adjacent radiators greatly improving multi-band operability, and a possibility to integrate an impedance matching network on the same carrier with at least partly the same production technique. The radiating element alternately extending in positive and negative angular directions in relation to its central axis, should be understood as including the radiating element describing a meander curve changing circumferential direction at least once in its extension along a longitudinal axis of an imaginary cylindrical shell, preferably having a circular or elliptic base.

When the antenna means includes one or more additional radiating element(s), operability within a wider frequency band or two or more separated frequency bands is achieved. It is possible to produce all radiating elements simultaneously in the same sequence of process steps.

When restriction of the electromagnetic energy bound in the radiating structure is specifically important, it does not include any complete turns at all and, preferably, it may only include configurations describing small fractions of a full turn around a central axis.

The first and second feed points may be interconnected and coupled in common to circuitry of the radio communication device. This could also be applied when using more than two radiating elements. Alternatively, the different radiating elements may be connected separately to the radio circuitry.

The antenna device preferably includes a dielectric carrier carrying the radiating structure to project it outwards from a chassis of a radio communication device on which the device is to be mounted. This enables an efficient radiation pattern. The carrier is preferably a dielectric flexible film or laminate having the radiating structure applied thereon or therein in the form of a conductive film structure, possibly obtained through an etching process. A printing technique is suitable for manufacturing in large quantities.

It may be advantageous to combine the antenna means according to the invention with an extendable and retractable whip antenna, as will be appreciated from the following description of preferred embodiments. The carrier and conductors of the antenna means will then possibly include one or more switches for connecting or disconnecting different radiating elements in different operating modes.

Especially when the carrier is a flexible film with a printed circuit pattern it is advantageous to integrate on the carrier an impedance matching means for matching impedances of any radiating element on the film or in combination with that structure to circuitry of the radio communication device, usually interfacing at 50 ohms.

DESCRIPTION OF PREFERRED EMBODIMENTS

Figure 1A:
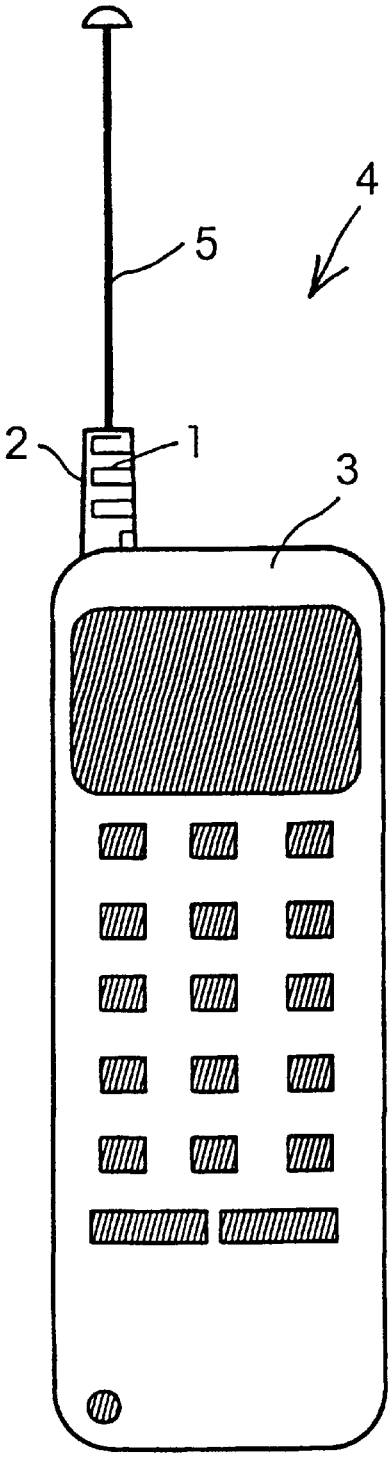
FIGS. 1A–B show a hand portable mobile telephone equipped with an antenna means according to various fundamentally similar embodiments of the invention, wherein a meander conductor extending in a cylindrical fashion and projecting outwards from chassis of the telephone, which is also provided with an extendable and retractable whip antenna.
Figure 1B:
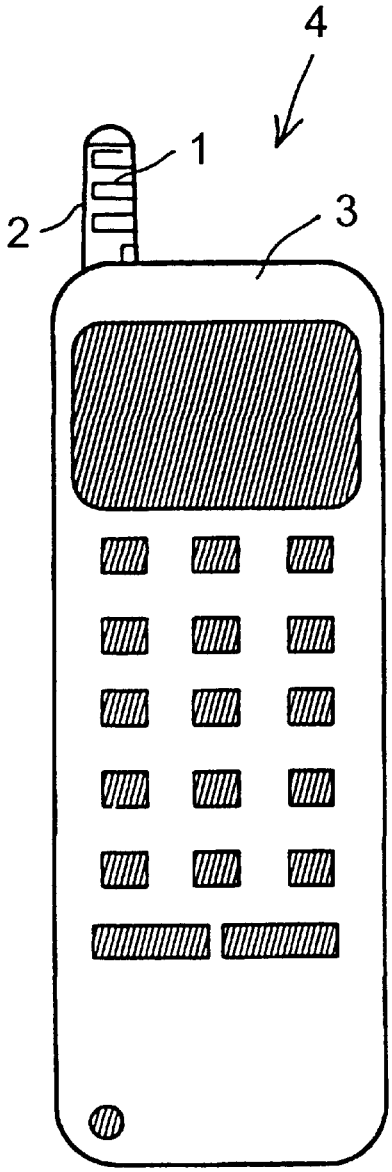

With reference to FIG. 1A, a meander radiating element 1 is carried by a dielectric cylindrical carrier 2 and mounted extending outwards on a chassis 3 of a hand portable mobile telephone 4. The position of the meander element 1 on the chassis 3 is selected such that radiation of the meander conductor 1 is transmitted and received effectively in different positions chosen by an operator during standby or during a telephone call. In FIGS. 1A–B the meander element is located at one side of a top portion of the chassis 3 projecting upwards.

Also shown in FIG. 1A is an extendable and retractable whip antenna 5 shown in its extended position. There may or may not be a whip antenna combined with the meander element, depending on the antenna performance required in a specific case. FIG. 1B shows the arrangement of FIG. 1A having the whip antenna in its retracted position.

Figure 2A:
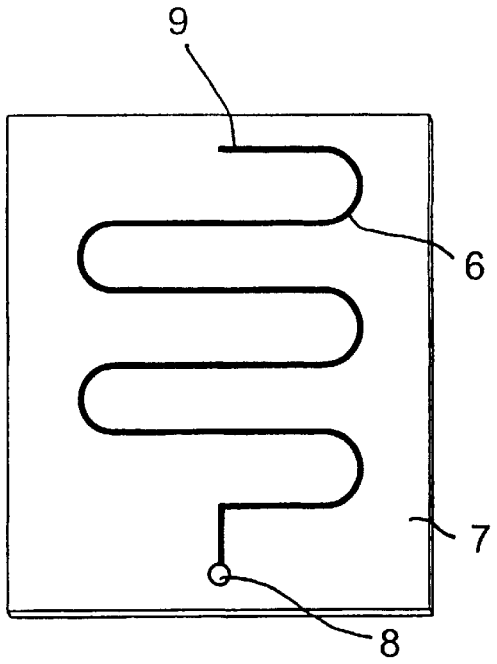
FIGS. 2A–C show different possible meander conductor configurations provided on a flexible film carrier in accordance with the invention.

FIG. 2A shows a first possible shape 6 of the meander radiating element being an etched conductor pattern on a dielectric flexible film carrier 7 in a flat configuration. The radiating element extends from a feed point 8 at one edge of the carrier 7, which has an essentially rectangular shape, in an alternating curve including parallel sections and semicircular turns to a free end 9 at an opposite edge of the carrier 7. The single meander radiating element is to be formed from the flat configuration into a configuration wherein the carrier 7 is tubular or, at least forms part of a cylinder, which will be shown further below.

Figure 2B:
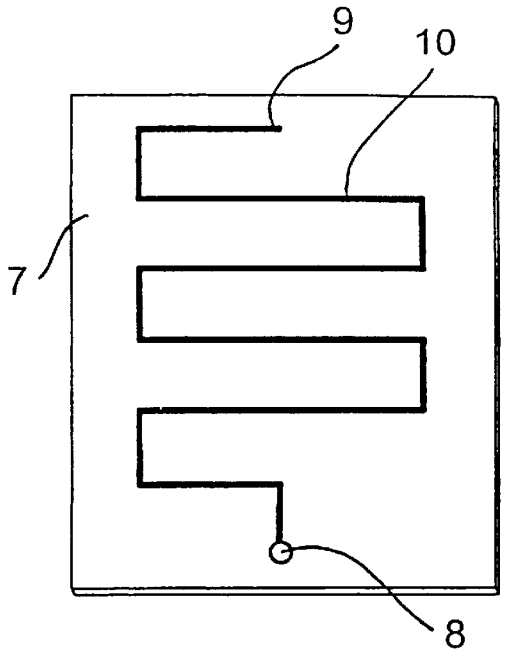
Figure 2C:
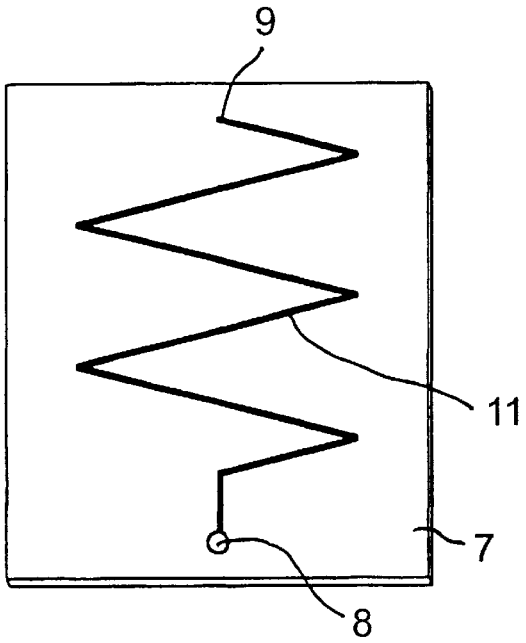

FIGS. 2B and 2C show, with corresponding reference numerals, second and third alternative shapes 10, 11, of the meander element, including rectangular and saw tooth shapes, respectively, extending on and to be formed together with the carrier 7 in a similar fashion to that of the meander element of FIG. 2A.

Figure 2D:
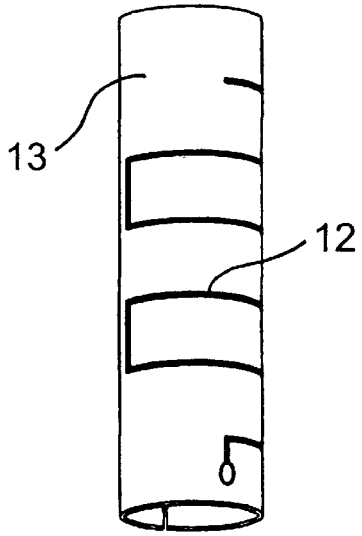
FIG. 2D shows the flexible film carrier carrying the meander conductor formed into a cylindrical configuration, which could for example be used for substituting a helical conductor in various antenna applications.

FIG. 2D shows a preferred cylindrical configuration into which the meander element 12 and the flexible film carrier 13 are shaped together. This configuration is compact and provides high durability. It can be used in most antenna applications where essentially the space occupied by a helical antenna is available, and, in particular, when a higher performance than that of a helical radiating element is required. Alternatively the flexible film carrier could be exchanged for another dielectric carrier, preferably having a cylindrical shape with some suitable cross-section, on which a meander conductor may also be applied or developed by a high precision technique, for example etching. As seen in FIG. 2A, the configuration can be said to have an imaginary central axis which the meander element 12 is arched about so that the angle relative the axis increases and decreases alternately.

Figure 3A:
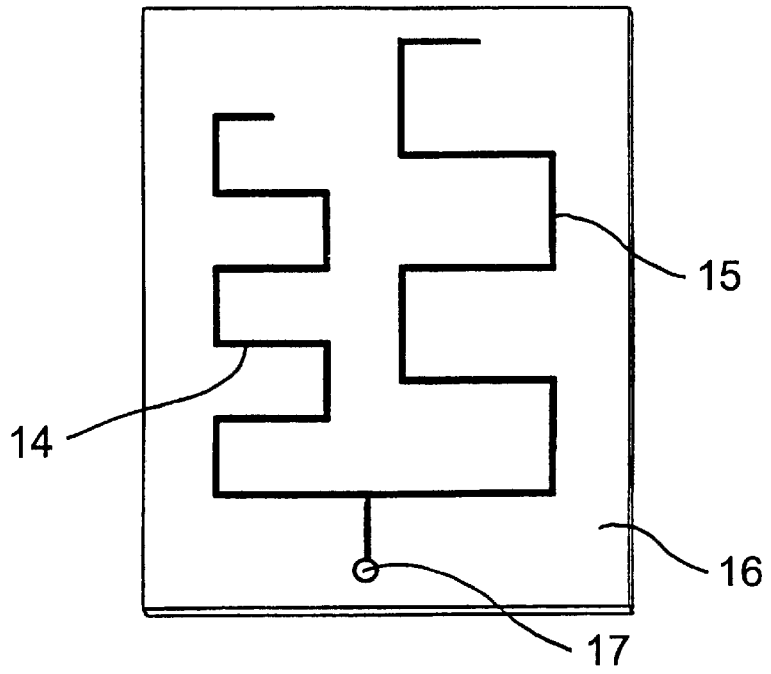
FIGS. 3A—B show dual meander conductors tuned to different frequencies on common flexible film carriers providing dual band operability of an antenna means according to the invention, the dual meander conductors either being fed separately or via a common feed point.

With reference to FIG. 3A, dual meander elements 14, 15 on a common carrier 16 are shown, which are tuned to two different frequencies allowing operation of the antenna means in two overlapping or separated frequency bands. These elements are fed by a common feed point 17 to be coupled to circuitry of a hand portable mobile telephone, possibly via an impedance matching means (not shown). It would also be possible to arrange more than two meander elements together in order to achieve operability in more than two frequency bands or still wider band(s) than could be achieved by two elements. Although depicted in a well-functioning flat configuration in FIG. 3A, the flexible film carrier of the multi meander means is preferably intended to be formed in to a cylindrical configuration as described above for a single meandering element.

It can be shown by calculations and confirmed by simulations and tests, that meander elements provide a great advantage over helical elements for operation within separated or wider frequency bands, since a degree of coupling between the individual elements is much less for meander elements than for helical elements assuming the same or comparable geometrical separations.

Figure 3B:
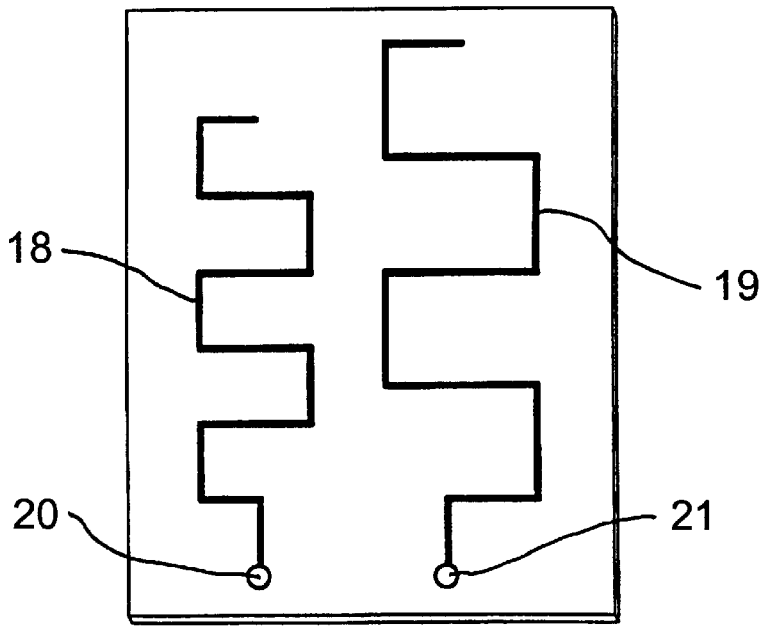

FIG. 3B shows an alternative to the feed arrangement of FIG. 3A. Here, the individual elements 18, 19 each have their own feed point 20, 19, respectively, to be coupled individually to circuitry of the telephone, possibly via an impedance matching means.

Figure 4:
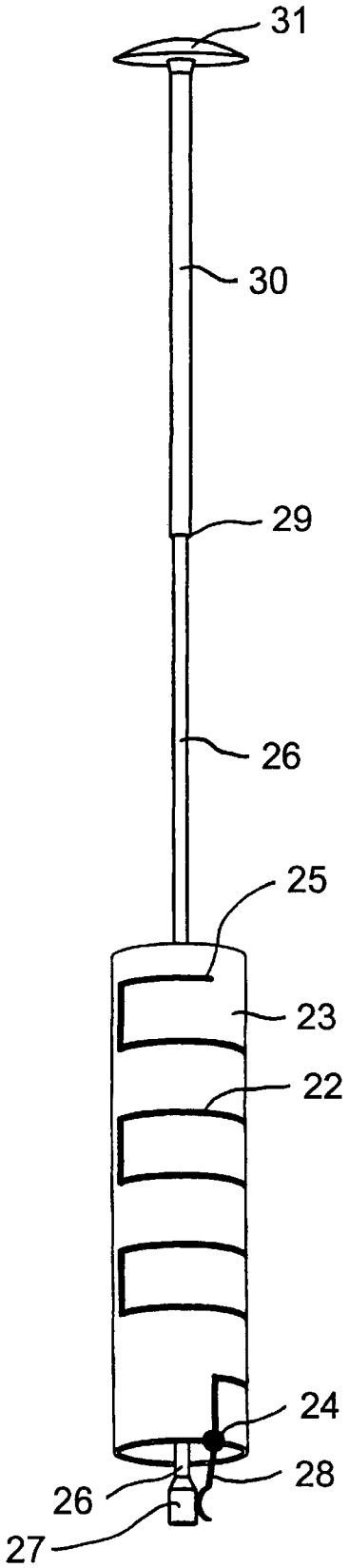
FIG. 4 shows a combination of a meander conductor having a cylindrical configuration and an extendable and retractable whip antenna.

With reference to FIG. 4, a combination is shown, including a cylindrically configured meander radiating element 22 carried by a cylindrical flexible film carrier 23, one point thereof being a feed point 24 and the other being a free end 25, an extendable conductive whip antenna 26 having a stopper 27 at a lower end which is adapted to contact the feed point 24 of the meander element 22 via a contact member 28 when the whip antenna 26 is extended, as is shown in FIG. 4, and having at the opposite end 29 an elongated dielectric portion 30 of the whip antenna terminated by a knob 31 for holding when sliding the whip antenna 26.

Figure 8:
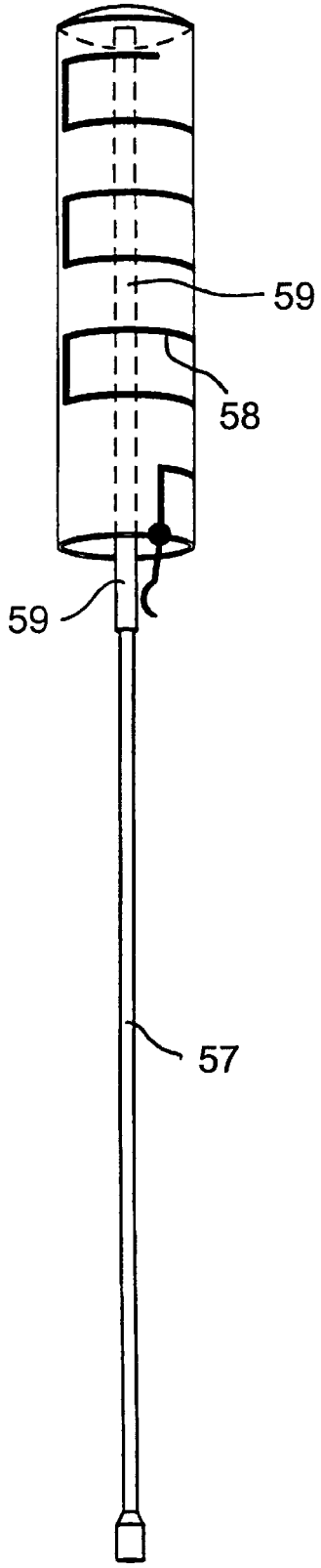
FIG. 8 shows a combination of a meander conductor and an extendable and retractable whip antenna, wherein the whip antenna is in a retracted position.

The length of the elongated dielectric portion 30 is essentially equal to the length of the cylindrically configured meander element 22, so that the whip antenna 26 does not co-extend with the meander element 22 is the retracted position (indicated in FIG. 8).

The radiators 22, 26 of the antenna means in FIG. 4 are preferable both of the same type, e.g., half-wave or quarter-wave type.

Generally, when a higher antenna performance is required, for example during a telephone call, generally, the whip antenna will be extended and contacted via the contact member to the feed point of the meander element, so that the meander element and the whip antenna will be connected in parallel to the circuitry of the telephone. In this configuration the whip antenna effects most of the antenna function. It will also be possible to provide an antenna of this type with more complicated switching means which would completely disconnect one of the elements when not needed.

Figure 5:
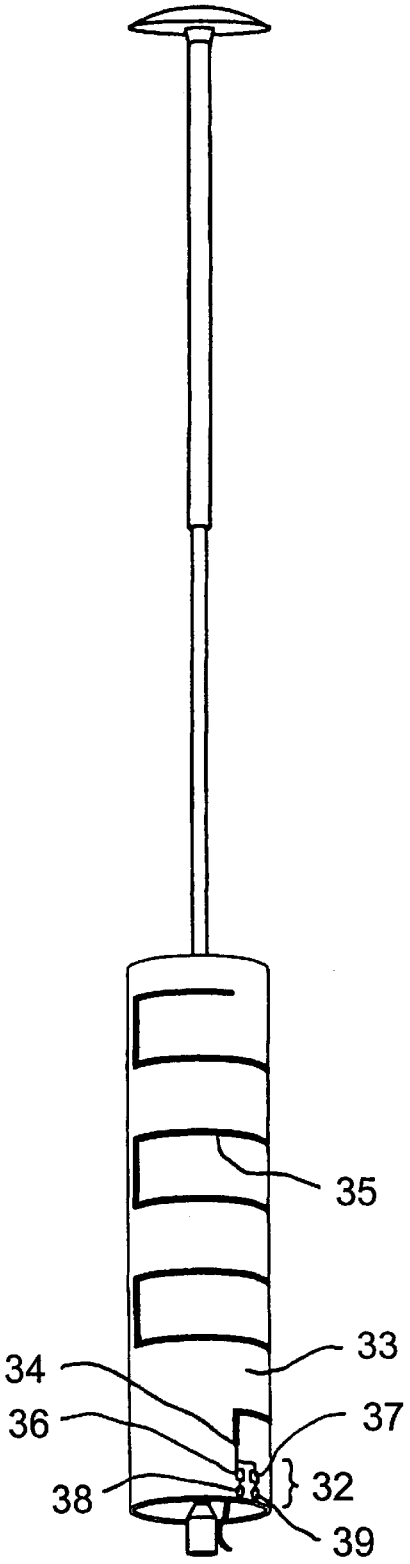
FIG. 5 shows a combination of a meander conductor having a cylindrical configuration and an extendable and retractable whip antenna, wherein a flexible film carrier of the meander conductor is provided with matching means for matching the impedances of the meander conductor and the whip antenna, respectively, to an impedance on transmitter/receiver circuitry of a mobile telephone.

In FIG. 5 there is shown schematically a general way to arrange an impedance matching means 32 integrated on a dielectric carrier 33 of the inventive antenna device. The matching means 32 is connected to a feed point 34 of a meander element 35 and includes reactive components 36, 37 (shown schematically) and connection terminals 38, 39 for signal and ground connectors (not shown) of the telephone.

Figure 6:
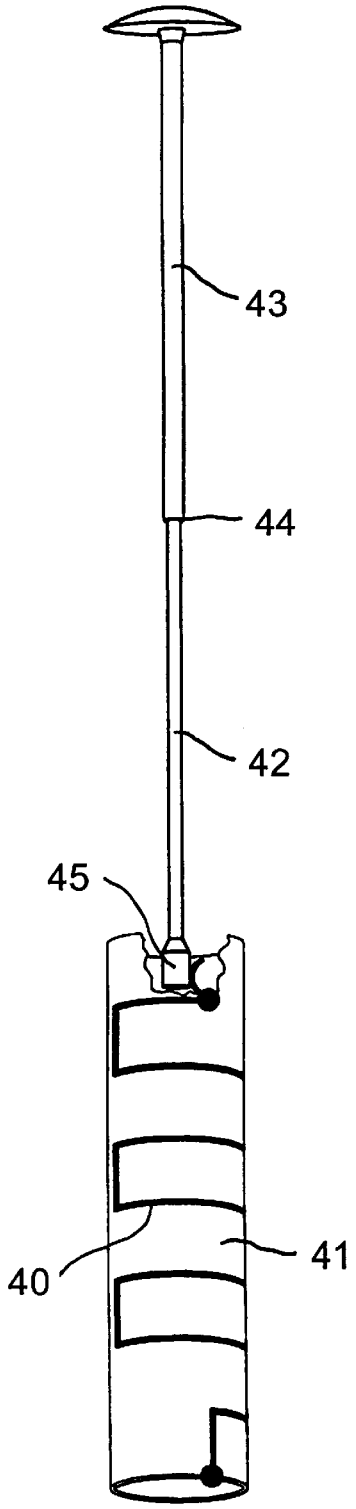
FIG. 6 shows another combination of a meander conductor having a cylindrical configuration and an extendable and retractable whip antenna, wherein the meander conductor and the whip antenna are connected in series when the whip antenna is in its extended position.

The arrangement of FIG. 6 includes, preferably an essentially quarter-wave meander element 40 on a cylindrical dielectric carrier 41, preferably an essentially half-wave extendable and retractable whip antenna 42 having a dielectric elongated portion 43 mounted at an upper end 44. This arrangement differs further from that of FIG. 4 in that the whip antenna 42 is fed in its extended position, either conductively or capacitively, at its lower end 45 by a top portion of the meander element 40.

Figure 7:
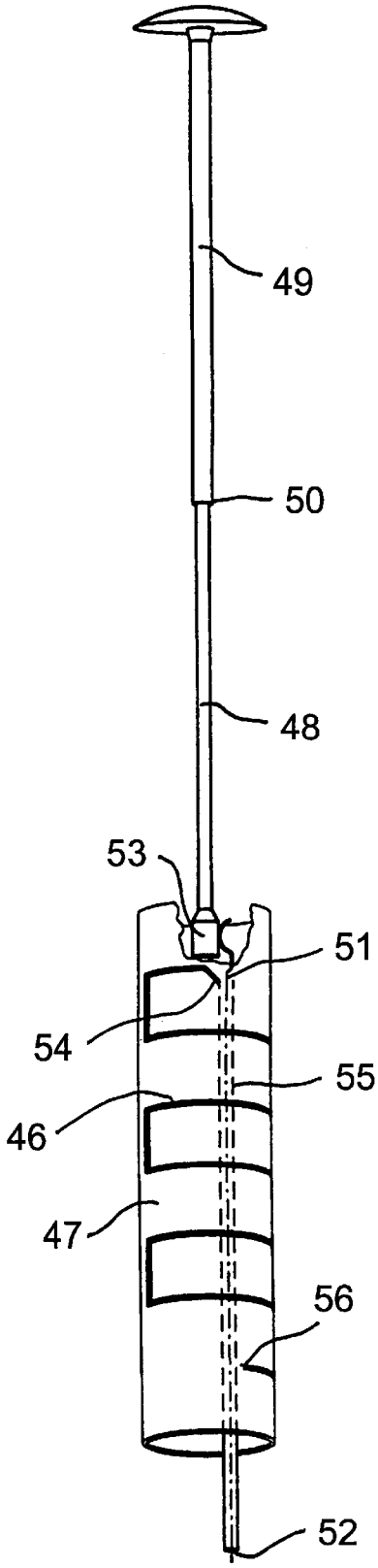
FIG. 7 shows yet another combination of a meander conductor and an extendable and retractable whip antenna, wherein a coaxial transmission line is connected to the meander conductor and the whip antenna, respectively.

The arrangement of FIG. 7 includes, preferably an essentially quarter-wave meander element 46 on a cylindrical dielectric carrier 47, preferably an essentially quarter-wave extendable and retractable whip antenna 48 having a dielectric elongated portion 49 mounted at an upper end 50. This arrangement differs further from that of FIG. 4 in that the inner conductor 51 of a (coaxial) transmission line 51 feeds the whip antenna 48 in its extended position, either conductively or capacitively, at its lower end 53, and a top end 54 of the meander element 46 is fed by the shield 55 of the transmission line 52, while a lower end 56 of the meander element 46 is an open end.

In situations where the antenna means is required to be more compact, the whip antenna 57 will be retracted as shown in FIG. 8. Generally, the whip antenna 57 then provides little or none of the antenna function, while the meander element(s) 58 transmits and receives radiation power to and from the telephone. Here, the dielectric portion 59 extends along the full axial length of the meander element 58, so that the whip is decoupled in the retracted position.

Figure 9:
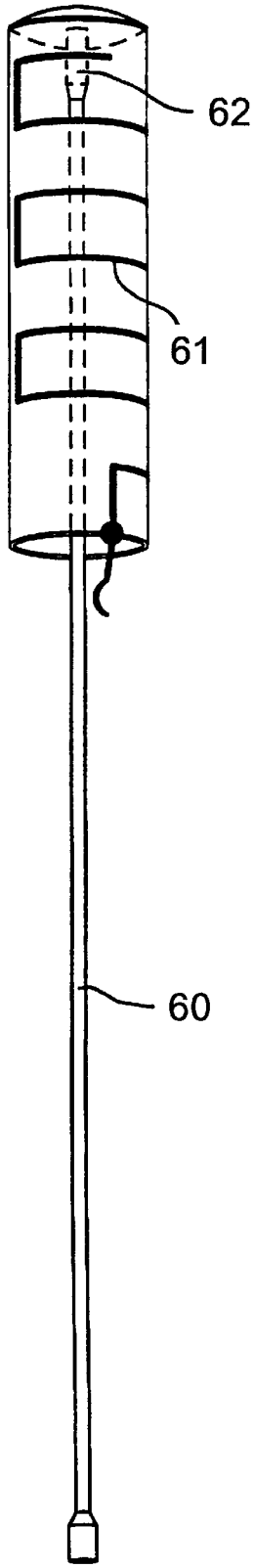
FIG. 9 shows a slightly different combination from that in FIG. 8, wherein the whip antenna is in a retracted position.

Alternatively, as is shown schematically in FIG. 9, to reduce the required receiving depth in the chassis of a hand portable mobile telephone, the whip antenna 60 may co-extend at least partially with the cylindrically configured meander element 61 even in the retracted position of the whip antenna 60. In that case the elongated dielectric portion 62 co-extends only partially with the meander element 61 when the whip antenna is retracted.

Figure 10A:
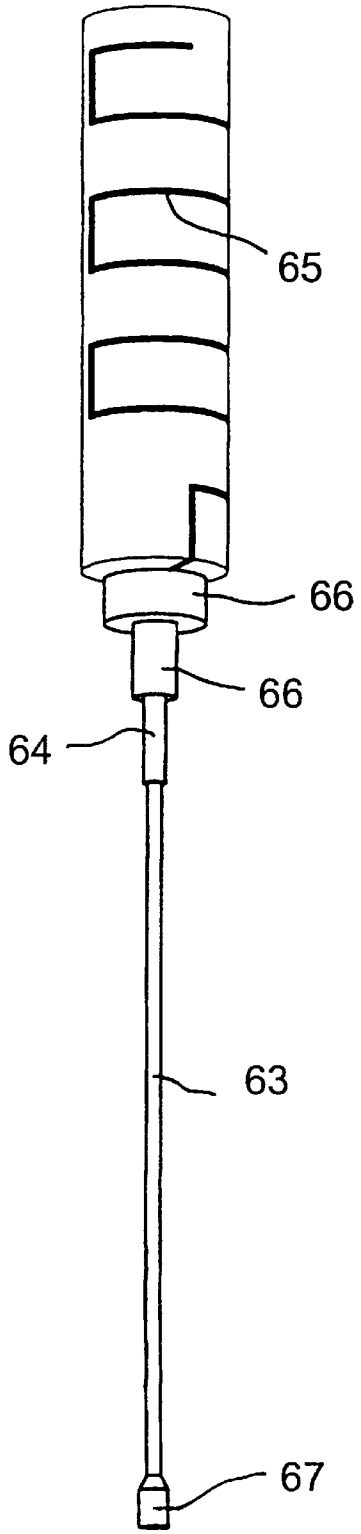
FIGS. 10A–B show still another combination of a meander conductor and an extendable and retractable whip antenna, wherein a top portion of the whip antenna carries the meander conductor and may or may not be conductively connected thereto.
Figure 10B:
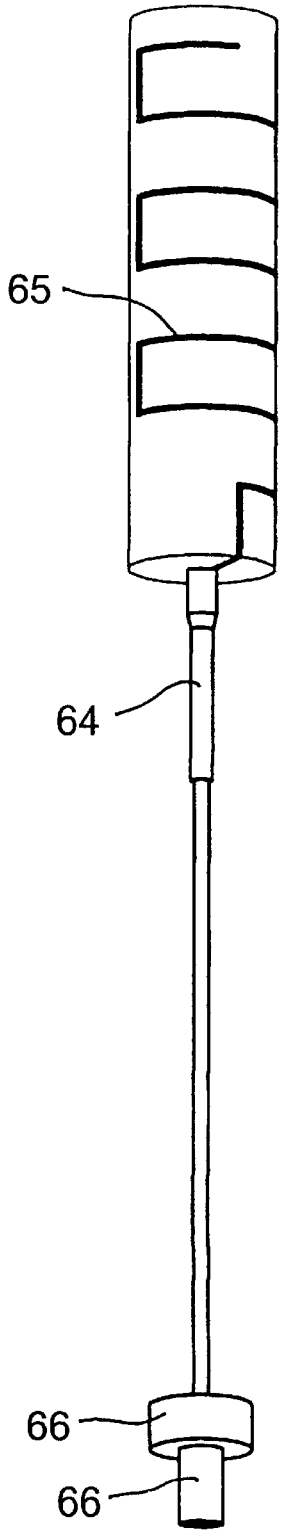

FIGS. 10A and 10B show in retracted and extended positions, respectively, a whip antenna 63 carrying at is top end 64 a meander element 65. A conductive sleeve 66 constitutes a connection point to circuitry (or a matching means) of a telephone. Either, there is a conductive connection between the whip and meander elements, so that they together contact the sleeve 66 at the portion 64 when retracted and at a portion 67 when extended, or there is no conductive contact, so that the meander element 65 alone contacts the sleeve 66 in the retracted position and the antenna whip 63 alone contacts the sleeve 66 in the extended position.

Various multi-band antenna means may be constructed according to the principles described above with reference to FIGS. 4–10 if more than one meander element are included.

Although the invention has been described in conjunction with a number of preferred embodiments, it is to be understood that various modifications may still be made without departing from the spirit and scope of the invention as defined by the appended claims. One such possible modification is providing the feeding means and feeding configurations differently from those shown in FIGS. 4–10.

What is claimed is:

1. An antenna for a portable communication device, comprising:

a radiating first element tuned to a first frequency, the first element having a central longitudinal first axis, first and second ends being a first feed point and a first open end, respectively, and arranged in a meander configuration, wherein the first element extending in positive and negative angular directions around said first axis so as to describe a meander curve changing circumferential direction at least once in its extension, and wherein the radiating element being included in the antenna a feed point and a first open end.

2. The antenna according to claim 1, further comprising:

a radiating second element tuned to a second frequency different from the first frequency, the second element having a central longitudinal second axis, first and second ends being a second feed point and a second open end, respectively, and arranged in a meander configuration, the second element alternately extending in positive and negative angular directions in relation to the second axis.

3. The antenna according to claim 2, further comprising:

at least one further radiating element having the meander configuration and being similar to the first and second elements, but tuned to a third frequency different from the first and second frequencies.

4. The antenna according to claim 1, wherein the radiating element does not include a full turn around its central axis.

5. The antenna according to claim 1, further comprising:

a dielectric carrier carrying the radiating element and to be mounted on the radio communication device such that the radiating element projects outwards.

6. The antenna according to claim 5, further comprising:

the carrier having a carrier surface, the radiating element being formed by a conductive film provided on the carrier surface.

7. The antenna according to claim 5, further comprising:

the carrier being a flexible dielectric film having thereon a printed conductive film constituting the radiating element.

8. The antenna according to claim 5, further comprising:

an impedance matching means integrated on the dielectric carrier for matching impedance of the radiating element to the circuitry of the radio communication device.

9. The antenna according to claim 1, further comprising:

an extendable and retractable whip antenna operable in combination with the element having the meander configuration.

10. The antenna according to claim 9, wherein the element having the meander configuration being fixed to a of a radio communication device and through which chassis the extendable and retractable whip antenna is slidable, the element having the meander configuration being coupled to circuitry of the radio communication device when the whip antenna is in a retracted position, the whip antenna being coupled to the circuitry when the whip antenna is in an extended position.

11. The antenna according to claim 9, wherein the element having the meander configuration, preferably has substantially quarter-wave characteristics, is fixed to a chassis of a radio communication device and through which the extendable and retractable whip antenna, preferably having substantially half-wave characteristics, is to be slidable, the element having the meander configuration being coupled to circuitry of the radio communication device when the whip antenna is in a retracted position, the whip antenna being coupled, preferably capacitively, to the circuitry via an upper portion of the element having the meander configuration when the whip antenna is in an extended position.

12. The antenna according to claim 9, wherein the element having the meander configuration being fixed to a chassis of a radio communication device and through which the extendable and retractable whip antenna is slidable, the element having the meander configuration being coupled at an upper portion, via a transmission line extending through the element having the meander configuration, to circuitry of the radio communication device when the whip antenna is in a retracted position, the whip antenna being coupled at a lower portion, via the transmission line, to the circuitry when the whip antenna is in an extended position.

13. The antenna according to claim 9, wherein the element having the meander configuration being fixed to a chassis of a radio communication device and through which the extendable and retractable whip antenna is slidable, the element having the meander configuration being coupled to circuitry of the radio communication device when the whip antenna is in a retracted position, the whip antenna being decoupled from the circuitry and, in order to reduce an extension depth into the radio communication device, extends at least partly inside the element having the meander configuration when the whip antenna is in a retracted position.

14. An antenna for a portable radio communication device, comprising:

a radiating first element tuned to a first frequency, the first element having a central longitudinal first axis, first and second ends being a first feed point and a first open end, respectively, and arranged in a meander configuration, wherein the first element extending in positive and negative annular directions in said first axis so as to describe a meander curve changing circumferential direction at least once in its extension, and an extendable and retractable whip antenna operable in combination with the element having the meander configuration.

15. The antenna according to claim 14, wherein the radiating element does not include a full turn around its central axis.

16. The antenna according to claim 14, further comprising:

a dielectric carrier carrying the radiating element and being mounted on the radio communication device such that the radiating element projects outwards.

17. The antenna according to claim 16, further comprising:

the carrier having a carrier surface, the radiating element being formed by a conductive film provided on the carrier surface.

18. The antenna according to claim 16, further comprising:

the carrier being a flexible dielectric film having a printed conductive film thereon constituting the radiating element.

19. The antenna according to claim 18, wherein the dielectric film has substantially the shape of a wall of a cylinder or portion thereof.

20. The antenna according to claim 16, further comprising:

an impedance matching means integrated on the dielectric carrier for matching impedance of the radiating element to the circuitry of the radio communication device.

21. The antenna according to claim 14, wherein the element having the meander configuration being fixed to a chassis of a radio communication device and through which the extendable and retractable whip antenna is slidable, the element having the meander configuration being coupled to circuitry of the radio communication device when the whip antenna is in a retracted position, the whip antenna being coupled to the circuitry when the whip antenna is in an extended position.

22. The antenna according to claim 14, wherein the whip antenna being slidable into and out of a chassis of a radio communication device, the element having the meander configuration is fixed coaxially to one end of the whip antenna and is located at all times outside the chassis, the element having the meander configuration being coupled to circuitry of the radio communication device when the whip antenna is in a retracted position, the element having the meander configuration and the whip antenna being coupled in series to the circuitry when the whip antenna is in an extended position.

23. The antenna according to claim 14, wherein the whip antenna being slidable into and out of a chassis of a radio communication device, the element having the meander configuration is fixed coaxially to one end of the whip antenna and is located at all times outside the chassis, the element having the meander configuration being coupled to circuitry of the radio communication device when the whip antenna is in a retracted position, the whip antenna being coupled to the circuitry when the whip antenna is in an extended position.

24. The antenna according to claim 14, wherein the element having the meander configuration, preferably has substantially quarter-wave characteristics, and is fixed to a chassis of a radio communication device through which the extendable and retractable whip antenna, preferably having substantially half-wave characteristics, is slidable, the element having the meander configuration being coupled to circuitry of the radio communication device when the whip antenna is in a retracted position, and the whip antenna being coupled, preferably capacitively, to the circuitry via an upper portion of the element having the meander configuration when the whip antenna is in an extended position.

25. The antenna according to claim 14, wherein the element having the meander configuration being fixed to a chassis of a radio communication device and through which the extendable and retractable whip antenna is slidable, the element having the meander configuration being coupled at an upper portion, via a transmission line extending through the element having the meander configuration, to circuitry of the radio communication device when the whip antenna is in a retracted position, the whip antenna being coupled at a lower portion, via the transmission line, to the circuitry when the whip antenna is in an extended position.

26. The antenna according to claim 14, wherein the element having the meander configuration being fixed to a chassis of a radio communication device and through which the extendable and retractable whip antenna is slidable, the element having the meander configuration being coupled at an upper portion, via a transmission line extending through the element having the meander to circuitry of the radio communication device when the whip antenna is in a retracted position, the whip antenna being coupled at a lower portion, via the transmission line, to the circuitry when the whip antenna is in an extended position.

27. The antenna according to claim 14, further comprising:

at least one further radiating element having a meander configuration and being similar to the first element, but tuned to a frequency different from the first frequency.

28. The antenna according to claim 14, wherein the element having the meander configuration is fixed to a chassis of a radio communication device and through which the extendable and retractable whip antenna is to be slidable, the element having the meander configuration being coupled to circuitry of the radio communication device when the whip is in a retracted position, and the whip antenna being decoupled from the circuitry and, in order to reduce an extension depth into the radio communication device, extends at least partly inside the element having the meander configuration when the whip antenna is in a retracted position.

29. An antenna for a portable radio communication device, comprising:

a radiating first element tuned to a first frequency, the first element having a central longitudinal first axis, first and second ends being a first feed point and a first open end, respectively, and arranged in a meander configuration, a radiating second element tuned to a second frequency different from the first frequency, the second element having a central longitudinal second axis, first and second ends being a second feed point and a second open end, respectively, and arranged in a meander configuration, the first and second elements extending in a generally cylindrical fashion along said first axis in alternately positive and negative circumferential directions in relation to the first and second axis respectively, the antenna being operable within first and second frequency bands surrounding the first and second frequencies, respectively.

30. The antenna according to claim 29, wherein none of the radiating elements include a full turn around its central axis.

31. The antenna according to claim 29, wherein the first and second feed points are interconnected.

32. The antenna according to claim 29, further comprising:

a dielectric carrier carrying the radiating elements and mounted on the radio communication device such that the radiating elements project outwards.

33. The antenna according to claim 32, further comprising:

the carrier having a carrier surface, the radiating elements being formed by a conductive film provided on the carrier surface.

34. The antenna according to claim 32, further comprising:

the carrier being a flexible dielectric film having a printed conductive film thereon constituting the radiating elements.

35. The antenna according to claim 34, wherein the dielectric film has substantially the shape of a wall of a cylinder or portion thereof.

36. The antenna according to claim 32, further comprising:

an impedance matching means integrated on the dielectric carrier for matching impedance(s) of radiating element (s) to circuitry of the radio communication device.

37. The antenna according to claim 29, further comprising:

an extendable and retractable whip antenna operable in combination with the elements having the meander configuration.

38. The antenna according to claim 37, wherein the elements having the meander configuration being fixed to a chassis of a radio communication device and through which the extendable and retractable whip antenna is slidable, the elements having the meander configuration being coupled to circuitry of the radio communication device when the whip antenna is in a retracted position, the whip antenna being coupled to the circuitry when the whip antenna is in an extended position.

39. The antenna according to claim 37, wherein the whip antenna is slidable into and out of a chassis of a radio communication device, the elements having the meander configuration are fixed coaxially to one end of the whip antenna and are located at all times outside the chassis, the elements having the meander configuration being coupled to circuitry of the radio communication device when the whip antenna is in a retracted position, the elements having the meander configuration and the whip antenna being coupled in series to the circuitry when the whip antenna is in an extended position.

40. The antenna according to claim 37, wherein the whip antenna is slidable into and out of a chassis of a radio communication device, the elements having the meander configuration are fixed coaxially to one end of the whip antenna and are located at all times outside the chassis, the elements having the meander configuration are coupled to circuitry of the radio communication device when the whip antenna is in a retracted position, the whip antenna is coupled to the circuitry when the whip antenna is in an extended position.

41. The antenna according to claim 37, wherein the elements having the meander configuration, preferably having substantially quarter-wave characteristics, are fixed to a chassis of a radio communication device and through which the extendable and retractable whip antenna, preferably having substantially half-wave characteristics, is slidable, the elements having the meander configuration are coupled to circuitry of the radio communication device when the whip antenna is in a retracted position, the whip antenna is coupled, preferably capacitively, to the circuitry via an upper portion of the elements having the meander configuration when the whip antenna is in an extended position.

42. The antenna according to claim 37, wherein the elements having the meander configuration are fixed to a chassis of a radio communication device and through which the extendable and retractable whip antenna is slidable, the elements having the meander configuration are coupled at an upper portion, via a transmission line extending through the elements having the meander configuration, to circuitry of the radio communication device when the whip antenna is in a retracted position, the whip antenna is coupled at a lower portion, via the transmission line, to the circuitry when the whip antenna is in an extended position.

43. The antenna according to 37, wherein the elements having the meander configuration are fixed to a chassis of a radio communication device and through which the extendable and retractable whip antenna is slidable, the elements having the meander configuration are coupled to circuitry of the radio communication device when the whip antenna is in a retracted position, the whip antenna is decoupled from the circuitry and, in order to reduce an extension depth into the radio communication device, extends at least partly inside the elements having the meander configuration when the whip antenna is in a retracted position.

44. The antenna according to claim 29, wherein the elements having the meander configuration have a shape corresponding to at least part of a wall of a cylinder.

45. The antenna according to claim 29, further comprising:

at least one further radiating element having a meander configuration and being similar to the first and second elements, but tuned to a third frequency different from the first and second frequencies.

46. An antenna for a portable radio communication device, comprising:

a radiating first element tuned to a first frequency, the first element having a central longitudinal first axis, first and second ends being a first feed point and a first open end, respectively, and arranged in a meander configuration, a radiating second element tuned to a second frequency different from the first frequency, the second element having a central longitudinal second axis, first and second ends being a second feed point and a second open end, respectively, and arranged in a meander configuration, the antenna being operable within first and second frequency bands surrounding the first and second frequencies, respectively, wherein the first and second feed points are interconnected for common coupling to radio circuitry.

47. The antenna according to claim 46, wherein the radiating structure includes a small fraction of a full turn around its central axis.

48. The antenna according to claim 46, wherein its configuration is arched or bent.

49. The antenna according to claim 46, its configuration is flat.

50. The antenna according to claim 46, further comprising:

a dielectric carrier carrying the radiating element being mounted on the radio communication device such that the radiating elements project outwards.

51. The antenna according to claim 50, further comprising:

the carrier having a carrier surface, the radiating elements being formed by a conductive film provided on the carrier surface.

52. The antenna according to claim 50, further comprising:

the carrier being a flexible dielectric film having thereon a printed conductive film constituting the radiating elements.

53. The antenna according to claim 50, wherein the elements having the meander configuration are fixed to a chassis of a radio communication device and through which the extendable and retractable whip antenna is slidable, the elements having the meander configuration are coupled to circuitry of the radio communication device when the whip antenna is in a retracted position, the whip antenna is decoupled from the circuitry and, in order to reduce an extension depth into the radio communication device, extends at least partly inside the elements having the meander configuration when the whip antenna is in a retracted position.

54. The antenna according to claim 50, further comprising:

an impedance matching means integrated on the dielectric carrier for match impedance(s) of radiating element(s) to circuitry of the radio communication device.

55. The antenna according to claim 46, further comprising:

an extendable and retractable whip antenna operable in combination with the elements having the meander configuration.

56. The antenna according to claim 55, wherein the elements having the meander configuration are fixed to a chassis of a radio communication device and through which the extendable and retractable whip antenna is slidable, the elements having the meander configuration are coupled to circuitry of the radio communication device when the whip antenna is in a retracted position, the whip antenna is coupled to the circuitry when the whip antenna is in an extended position.

57. The antenna according to claim 55, wherein the elements having the meander configuration, preferably having substantially quarter-wave characteristics, are fixed to a chassis of a radio communication device and through which the extendable and retractable whip antenna, preferably having substantially half-wave characteristics, is slidable, the elements having the meander configuration are coupled to a circuitry of the radio communication device when the whip antenna is in a retracted position, the whip antenna is coupled, preferably capacitively, to the circuitry via an upper portion of the elements having the meander configuration when the whip antenna is in an extended position.

58. The antenna according to claim 55, wherein the elements having the meander configuration are fixed to a chassis of a radio communication device and through which the extendable and retractable whip antenna is slidable, the elements having the meander configuration are coupled at an upper portion, via a transmission line extending through the elements having the meander configuration, to circuitry of the radio communication device when the whip antenna is in a retracted position, the whip antenna is coupled at a lower portion, via the transmission line, to the circuitry when the whip antenna is in an extended position.

59. The antenna according to claim 46, further comprising:

at least one further radiating element having a meander configuration and being similar to the first and second elements, but tuned to a third frequency different from the first and second frequencies.

* * * * *